US007967635B2

(12) United States Patent
Amidon et al.

(10) Patent No.: US 7,967,635 B2
(45) Date of Patent: Jun. 28, 2011

(54) TIGHTENING INDICATOR FOR COAXIAL CABLE CONNECTOR

(75) Inventors: Jeremy Amidon, Marcellus, NY (US); Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/830,398

(22) Filed: Jul. 5, 2010

(65) Prior Publication Data

US 2010/0273352 A1 Oct. 28, 2010

Related U.S. Application Data

(63) Continuation of application No. 11/768,831, filed on Jun. 26, 2007, now Pat. No. 7,749,022, which is a continuation-in-part of application No. 11/735,449, filed on Apr. 14, 2007, now Pat. No. 7,507,117.

(51) Int. Cl.
*H01R 9/05* (2006.01)

(52) U.S. Cl. ..... 439/584; 439/488

(58) Field of Classification Search ..... 439/488–490, 439/578–585

See application file for complete search history.

(56) References Cited

U.S. PATENT DOCUMENTS

| | | | | |
|---|---|---|---|---|
| 4,655,159 | A * | 4/1987 | McMills | 116/212 |
| 6,716,062 | B1 * | 4/2004 | Palinkas et al. | 439/578 |
| 7,241,164 | B2 * | 7/2007 | Holliday | 439/491 |
| 7,507,117 | B2 | 3/2009 | Amidon | |
| 7,749,022 | B2 | 7/2010 | Amidon et al. | |

* cited by examiner

*Primary Examiner* — Edwin A. Leon
(74) *Attorney, Agent, or Firm* — Schmeiser, Olsen & Watts, LLP

(57) ABSTRACT

A coaxial cable connector includes an outer body having a first end and an opposing second end, an inner body having a first inner end and a second inner end, and a post interconnected with the inner body. A fastener portion is at the first end of the outer body. A compression sleeve is disposed to fit on the second inner end. The post, the inner body, and the compression sleeve are movable with respect to the outer body between a first position in which the connector is not mounted to an equipment port and a second position when the connector is mounted to the equipment port. When the fastener portion is mounted to the equipment port, an indicator portion on the compression sleeve is made visible to a user.

17 Claims, 14 Drawing Sheets

TIGHTENING INDICATOR FOR COAXIAL CABLE CONNECTOR

CROSS-REFERENCE TO RELATED APPLICATIONS

This application is a continuation of and claims priority from U.S. patent application Ser. No. 11/768,831 filed on Jun. 26, 2007 now U.S. Pat. No. 7,749,022 and entitled TIGHTENING INDICATOR FOR COAXIAL CABLE CONNECTOR, which in turn is a continuation in part of and claims priority from U.S. patent application Ser. No. 11/735,449 filed on Apr. 14, 2007 and entitled TIGHTENING INDICATOR FOR COAXIAL CABLE CONNECTOR, now issued as U.S. Pat. No. 7,507,117, all of which are incorporated herein by reference.

FIELD OF THE INVENTION

This invention relates generally to the field of coaxial cable connectors, and more particularly to a coaxial cable connector with a visual indicator showing when the connector is fully tightened onto an equipment port.

BACKGROUND OF THE INVENTION

A common problem with RCA coaxial cable connectors is that they do not stay tight on the ports they are connected to. Especially in vertical installations, the weight of the coaxial cable is great enough to loosen or pull the connector off the port. An RCA coaxial cable connector was devised that included a locking feature to prevent the RCA connector from pulling loose from the port. However, the RCA connector still needs to be locked properly upon installation for the locking feature to work properly. Determining whether the RCA connector is properly installed is not always easy to do when installing the RCA connector onto the equipment port.

With CATV (cable television) technology, it is extremely important to ensure that all connections are tight in order to prevent unwanted interference from getting into the transmission path. For bidirectional systems, it has been estimated that 70%-95% of the unwanted RF interference on the return path, from the subscriber to the headend, originates within the subscriber's premises or home. Because all the return signals funnel back into the headend, a single source of unwanted RF interference (RFI), also known as "ingress", affects the service of all the subscribers. The RFI enters the system from improperly installed F-connectors, cracked or improperly shielded coaxial cable, or simply bad shielding around a television set's tuner. Improper installation includes the failure to tighten fully the connector into an equipment port, thus causing signal leakage and intermittent grounding.

Cable operators are spending enormous amounts of money and resources to maintain the headend plant free from the RFI caused by loose and improper connections. New digital products such as VOIP (voice over internet protocol) are extremely sensitive to RFI ingress. Small levels of ingress can disrupt voice service or cause dropped calls.

SUMMARY OF THE INVENTION

Briefly stated, a coaxial cable connector includes an outer body having a first end and an opposing second end, an inner body having a first inner end and a second inner end, and a post interconnected with the inner body. A fastener portion is at the first end of the outer body. A compression sleeve is disposed to fit on the second inner end. The post, the inner body, and the compression sleeve are movable with respect to the outer body between a first position in which the connector is not mounted to an equipment port and a second position when the connector is mounted to the equipment port. When the fastener portion is mounted to the equipment port, an indicator portion on the compression sleeve is made visible to a user.

According to an embodiment of the invention, a coaxial cable connector includes an outer body having a first end and an opposing second end; an inner body having a first inner end and a second inner end; a post interconnected with the inner body; a fastener portion at the first end of the outer body; a compression sleeve disposed to fit on the second inner end; wherein the post, the inner body, and the compression sleeve are movable with respect to the outer body between a first position in which the connector is not mounted to an equipment port and a second position when the connector is mounted to the equipment port; and wherein when the fastener portion is mounted to the equipment port, an indicator portion on the compression sleeve is made visible to a user.

According to an embodiment of the invention, a coaxial cable connector for connection to an equipment port includes a connector body having a first end and a second end; the first end including a fastener portion which is connectable to the equipment port; the second end including an indicator portion; and an outer sleeve mounted on the connector body for movement between a first position wherein the outer sleeve covers the indicator portion and a second position wherein the outer sleeve visibly exposes the indicator portion on the connector body.

According to an embodiment of the invention, a method for making a coaxial cable connector for connection to an equipment port includes the steps of: (a) forming an outer body having a first end and an opposing second end; (b) forming an inner body having a first inner end and a second inner end; (c) forming a post interconnected with the inner body; (d) forming a fastener portion at the first end of the outer body; (e) forming a compression sleeve disposed to fit on the second inner end; (f) wherein the post, the inner body, and the compression sleeve are movable with respect to the outer body between a first position in which the connector is not mounted to the equipment port and a second position when the connector is mounted to the equipment port; and (g) wherein when the fastener portion is mounted to the equipment port, an indicator portion on the compression sleeve is made visible to a user.

According to an embodiment of the invention, a method of installing coaxial cable connector to an equipment port, wherein the connector includes an outer body having a first end and an opposing second end; an inner body having a first inner end and a second inner end; a post interconnected with the inner body; a fastener portion at the first end of the outer body; a compression sleeve disposed to fit on the second inner end; wherein the post, the inner body, and the compression sleeve are movable with respect to the outer body between a first position in which the connector is not mounted to an equipment port and a second position when the connector is mounted to the equipment port; and wherein when the fastener portion is mounted to the equipment port, an indicator portion on the compression sleeve is made visible to a user; the method including the steps of: (a) fitting the fastener portion over the equipment port; (b) moving the outer body to the second position; and (c) checking to ensure that the indicator portion is not concealed by the outer sleeve.

DETAILED DESCRIPTION OF THE PREFERRED EMBODIMENT

Figure 1:
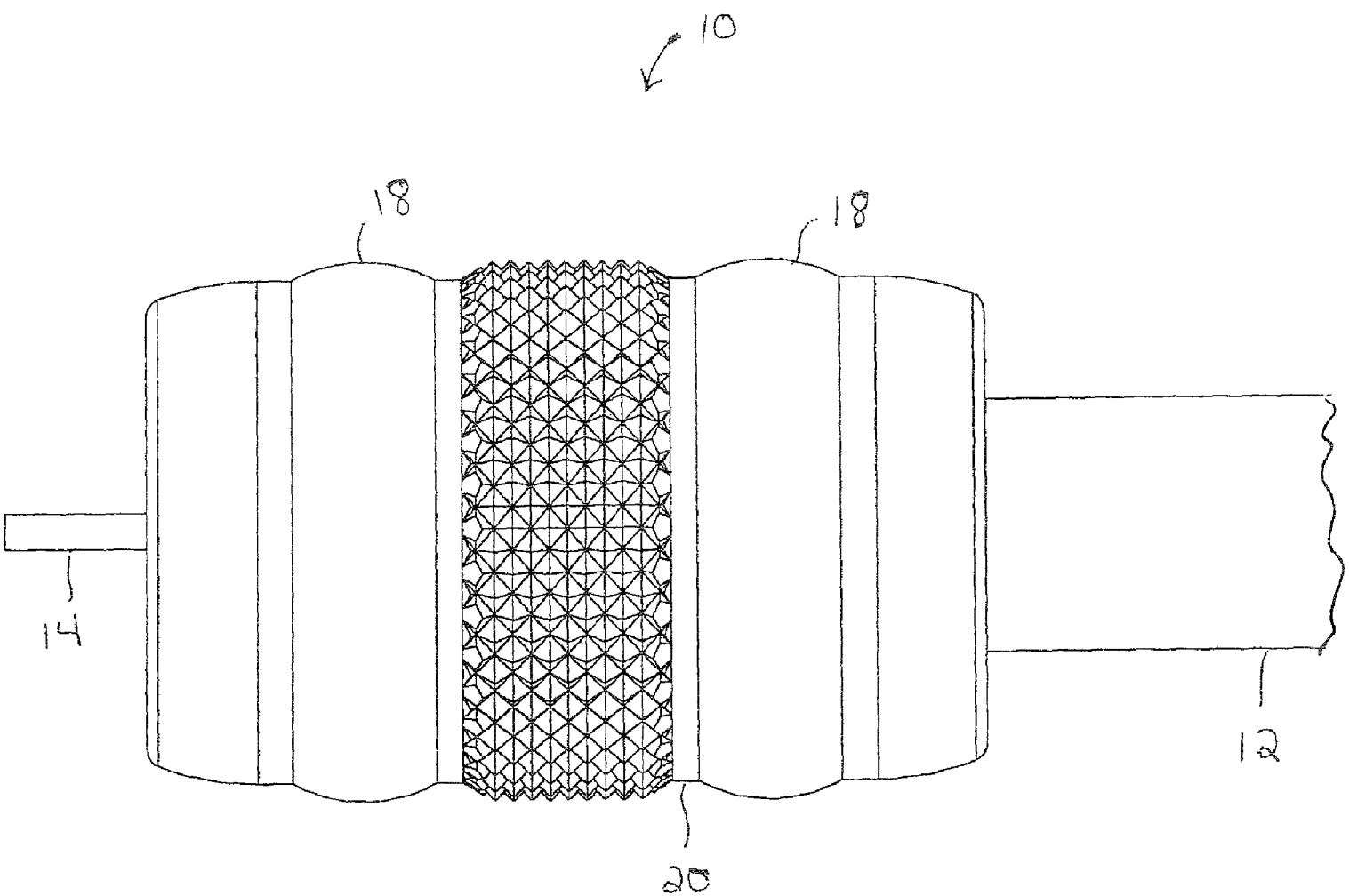
FIG. 1 shows a side elevation view of a coaxial cable connector according to an embodiment of the invention before the connector is tightened onto an equipment port.

Referring to FIG. 1, a coaxial cable connector according to an embodiment of the invention is shown. Connector 10 is shown connected to a coaxial cable 12, which connection leaves a center conductor 14 of coaxial cable 12 positioned to make contact with a signal input (not shown) of an equipment port (not shown) when connector 10 is connected into the equipment port. A plurality of elastomeric rings 18 are preferably around parts of outer body 20. Elastomeric rings 18 increase the ease of tightening connector 10 to the equipment port. Connector 10 is shown in an un-tightened state, that is, connector 10 is not screwed onto the equipment port. Connector 10 is shown here as an F-type connector.

Figure 2:
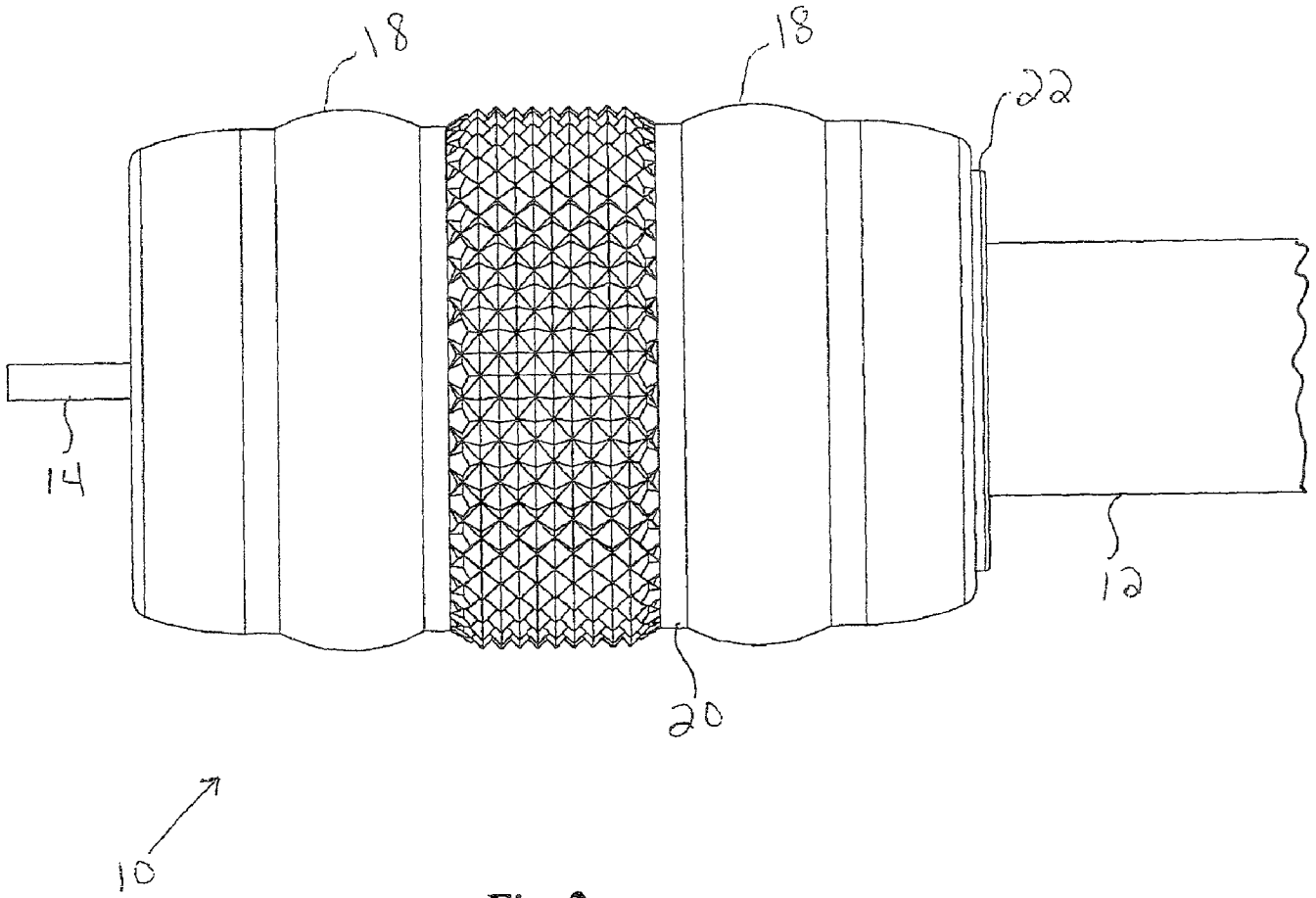
FIG. 2 shows a side elevation view of a coaxial cable connector according to an embodiment of the invention as the connector is tightened onto an equipment port.

Referring to FIG. 2, connector 10 is shown in either a partially tightened state according to one embodiment of the invention, or in a fully tightened state in another embodiment of the invention. Part of a compression sleeve 22 is now visible as it extends past outer body 20.

Figure 3A:
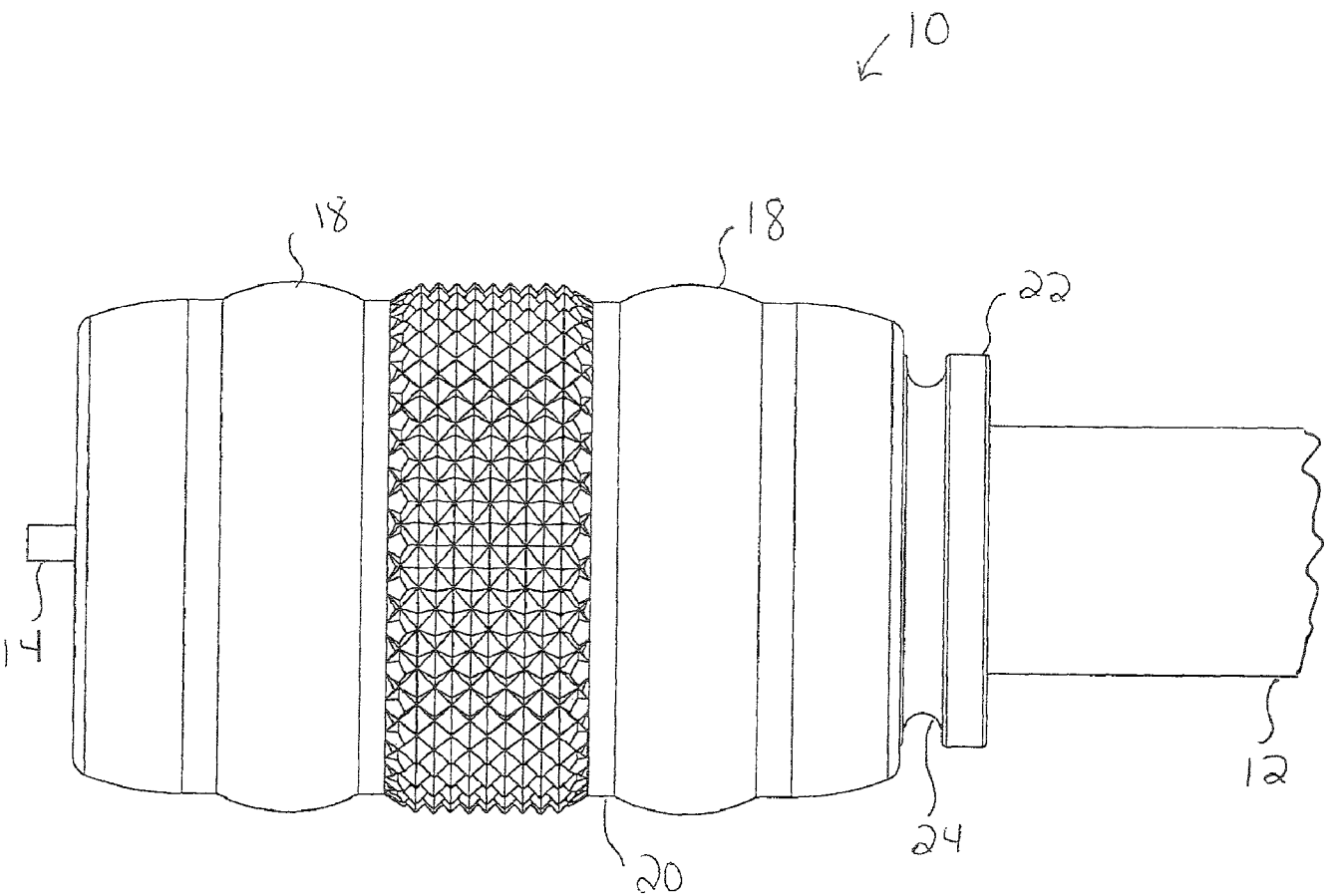
FIG. 3A shows a side elevation view of a coaxial cable connector according to an embodiment of the invention after the connector is fully tightened onto an equipment port.
Figure 3B:
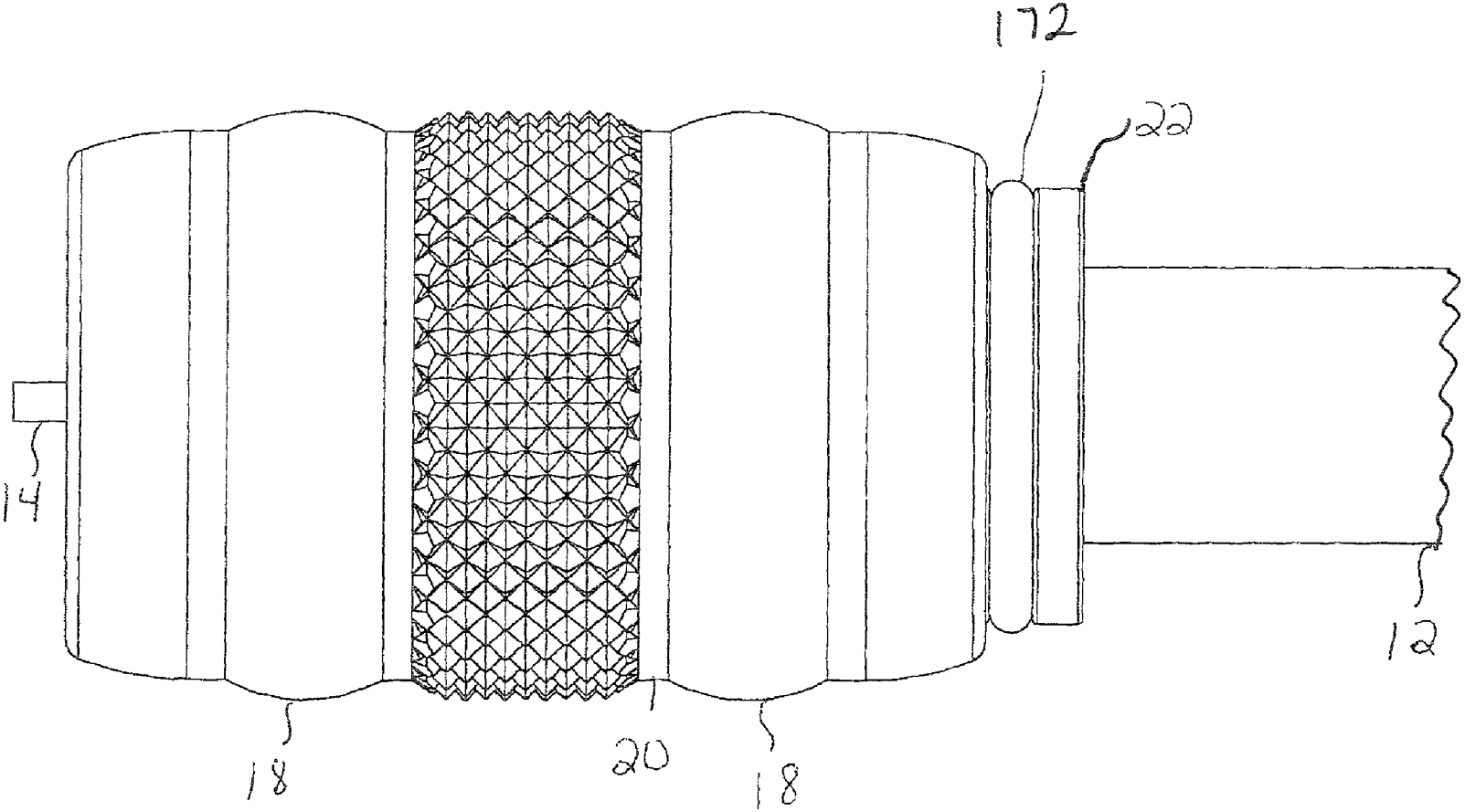
FIG. 3B shows a side elevation view of a coaxial cable connector according to an embodiment of the invention after the connector is fully tightened onto an equipment port.

Referring to FIGS. 3A-3B, a groove 24 in compression sleeve 22 is now visible as it extends past outer body 20 (FIG. 3A). An elastomeric band 172, preferably colored, is positioned in groove 24 in the embodiment of FIG. 3B. For the embodiment where FIG. 2 represents a partially tightened state, the embodiments in FIGS. 3A-3B represents the fully tightened state. Otherwise, FIGS. 2 and 3A-3B represent different embodiments with different visible indicators, i.e., in the embodiment of FIG. 2, the visible indicator of the fully tightened state is the appearance of a part of compression sleeve 22, while in the embodiment of FIG. 3A, the visible indicator of the fully tightened state is the appearance of groove 24 and in FIG. 3B, the visible indicator of the fully tightened state is the appearance of elastomeric band 172.

Figure 4:
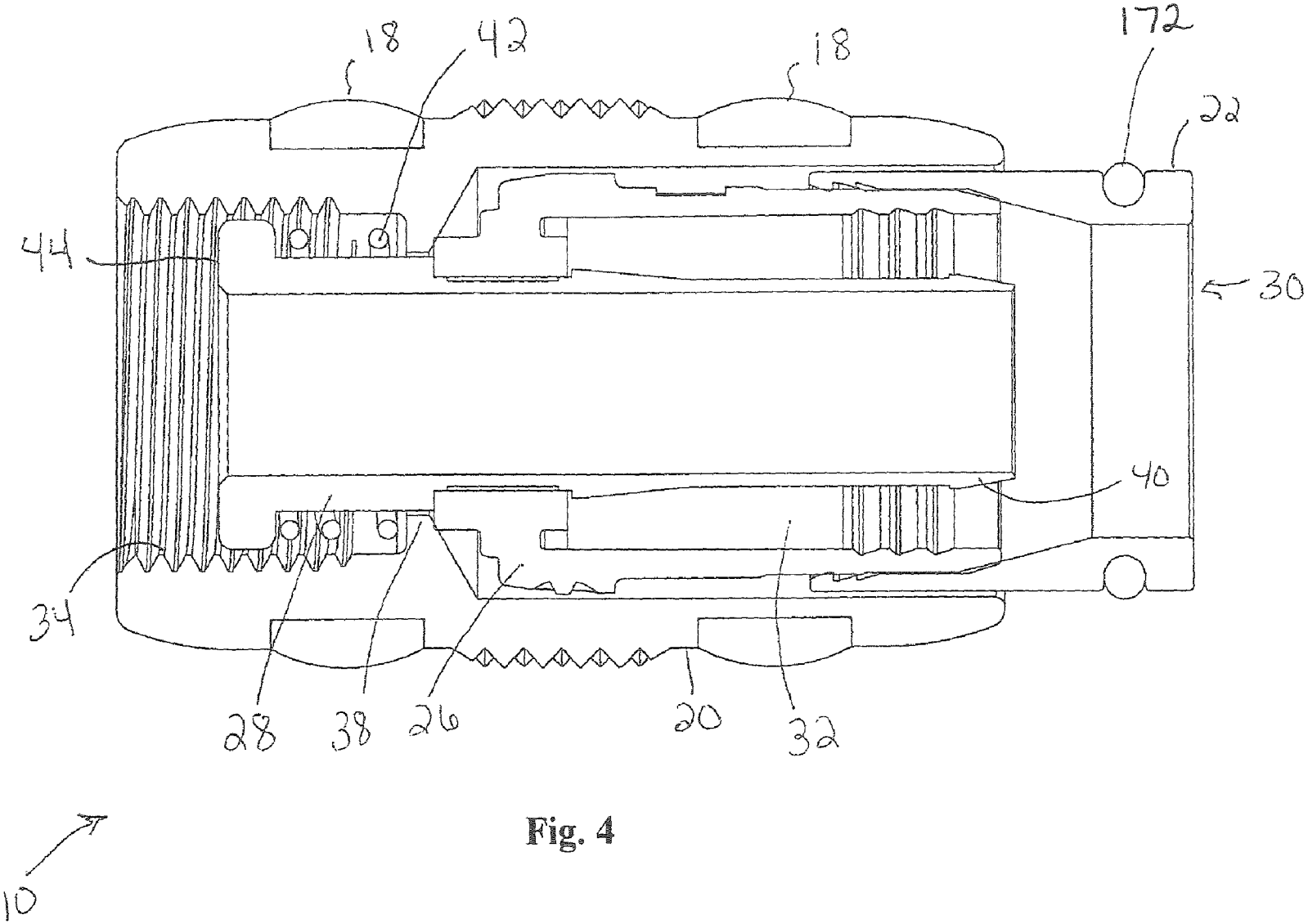
FIG. 4 shows a cutaway view of a coaxial cable connector according to an embodiment of the invention, with the connector not fastened (uncompressed) to a coaxial cable.

Referring to FIG. 4, a cutaway view of an embodiment of the invention is shown, with connector 10 in this embodiment shown in both the uncompressed state and the untightened state. "Uncompressed state" in this embodiment means that the compression sleeve has not been compressed into outer body 20, while "untightened state" continues to mean that connector 10 is not fastened onto the equipment port (not shown). When coaxial cable 12 (FIGS. 1-3B) is installed, a prepared end of cable 12 is inserted through an opening 30, with a dielectric (not shown) and center conductor 14 (FIGS. 1-3B) passing through a post 28, while an outer braid (not shown) and an outer covering (not shown) of cable 12 fit into a cavity 32. A tip 40 of post 28 passes between the dielectric and the outer braid of cable 12.

Figure 5A:
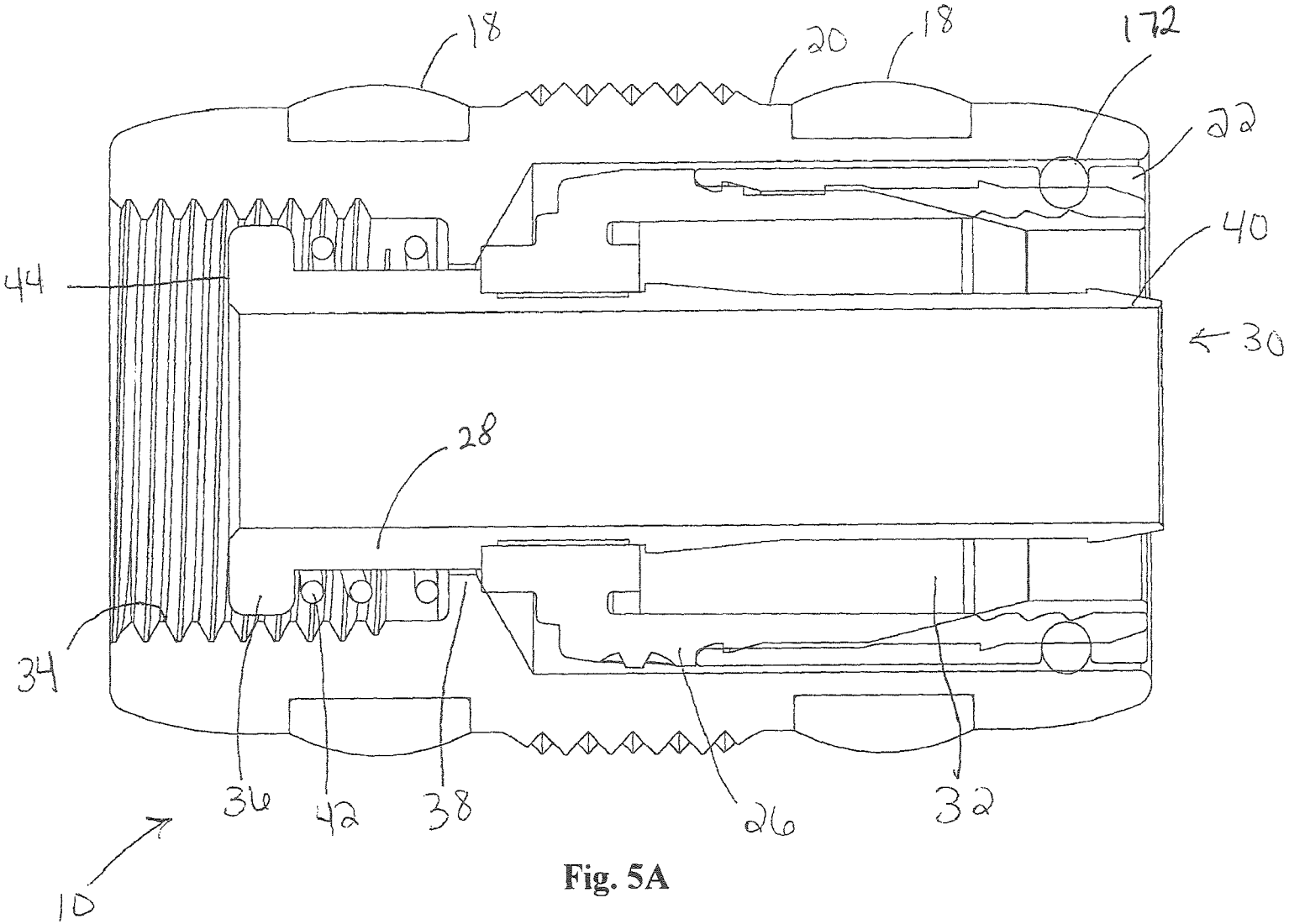
FIG. 5A shows a cutaway view of a coaxial cable connector according to an embodiment of the invention, with the connector fastened (compressed) to a coaxial cable but not tightened onto an equipment port, where the equipment port is an RF port.
Figure 5B:
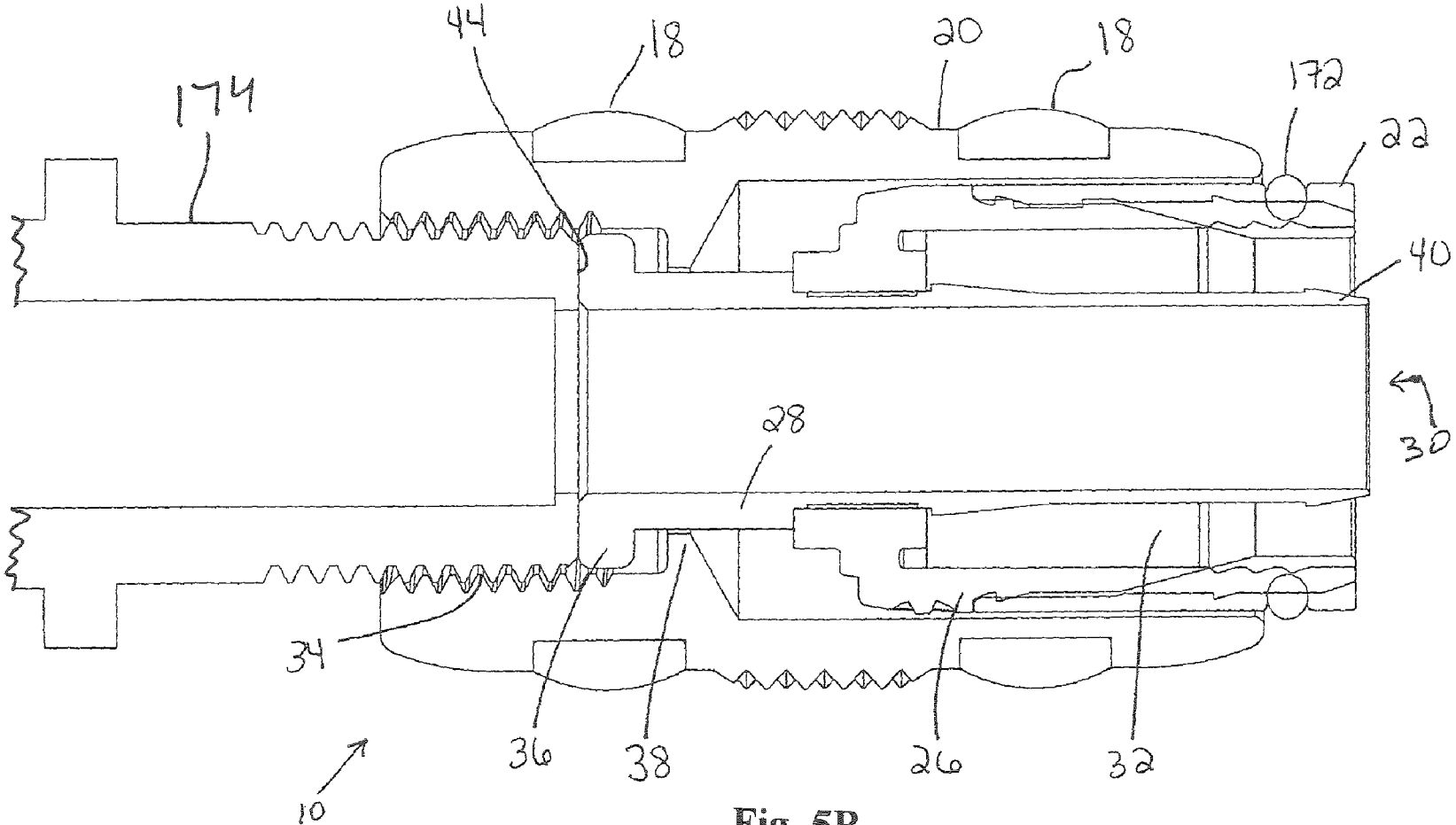
FIG. 5B shows a cutaway view of a coaxial cable connector according to an embodiment of the invention, with the connector fastened (compressed) to a coaxial cable and tightened onto an equipment port.

Referring to FIG. 5A, a cutaway view of an embodiment of the invention is shown, with connector 10 shown in both the compressed state and the untightened state. Note that compression sleeve 22 has been pushed between outer body 20 and inner body 26, compressing inner body 26 against the outer covering (not shown) of cable 12. Once cable 12 is properly connected to connector 10, connector 10 may be connected to the equipment port (not shown). Connector 10 is screwed onto the equipment port (not shown), with threads 34 on a portion of an inside of outer body 20 screwing into corresponding grooves (not shown) on the equipment port (not shown). As connector 10 is screwed onto the equipment port (not shown), an end 44 of post 28 is pushed by the equipment port (not shown), thus forcing a shoulder 36 of post 28 preferably against a spring 42 which in turn is forced against a shoulder 38 of outer body 20. As connector 10 becomes fully tightened onto the equipment port (not shown), the combination of post 28, inner body 26, and compression sleeve 22 moves with relation to outer body 20 so that eventually, in one embodiment, groove 24 on compression sleeve 22 is visible outside outer body 22 as is the case in FIG. 3A. In another embodiment shown in FIG. 5B, elastomeric band 172 is visible outside outer body 22 as is the case in FIG. 3B. FIG. 5B also shows an equipment port 174, with equipment port 174 being an RF port. In another embodiment, when connector 10 is fully tightened onto the equipment port (not shown), part of compression sleeve 22 appears outside outer body 22 as is the case in FIG. 2.

Figure 6:
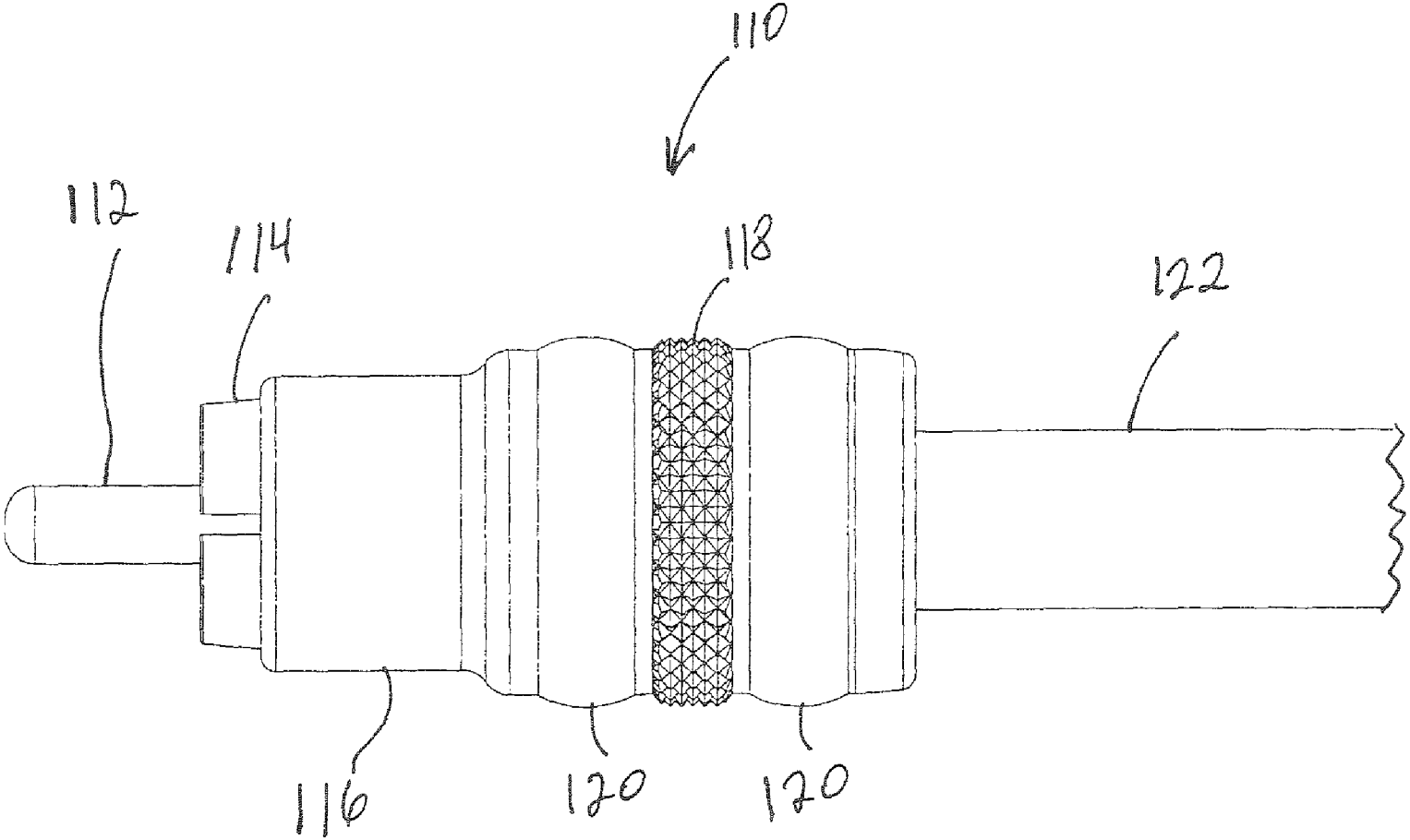
FIG. 6 shows a side elevation view of an RCA coaxial cable connector according to an embodiment of the present invention in an unlocked position.

Referring to FIG. 6, an embodiment of the present invention is an indicator, preferably visible, that shows when an RCA coaxial cable connector is fully tightened onto an equipment port. Such an RCA connector is described in U.S. patent application Ser. No. 11/371,807 filed Mar. 9, 2006 and entitled LOCKING PHONO PLUG, hereby incorporated herein by reference.

An RCA cable connector 110 is shown connected to a coaxial cable 122. Cable connector 110 includes a conductive pin 112, an outer sleeve 116, and preferably elastomeric rings 120 on either side of a knurled surface 118. A plurality of engagement fingers 114 are present for connecting and locking onto an equipment port (not shown). Cable connector 110 is referred to in this state as installed on coaxial cable 122, but unlocked. That is, cable connector 110 is not locked onto the equipment port.

Figure 7:
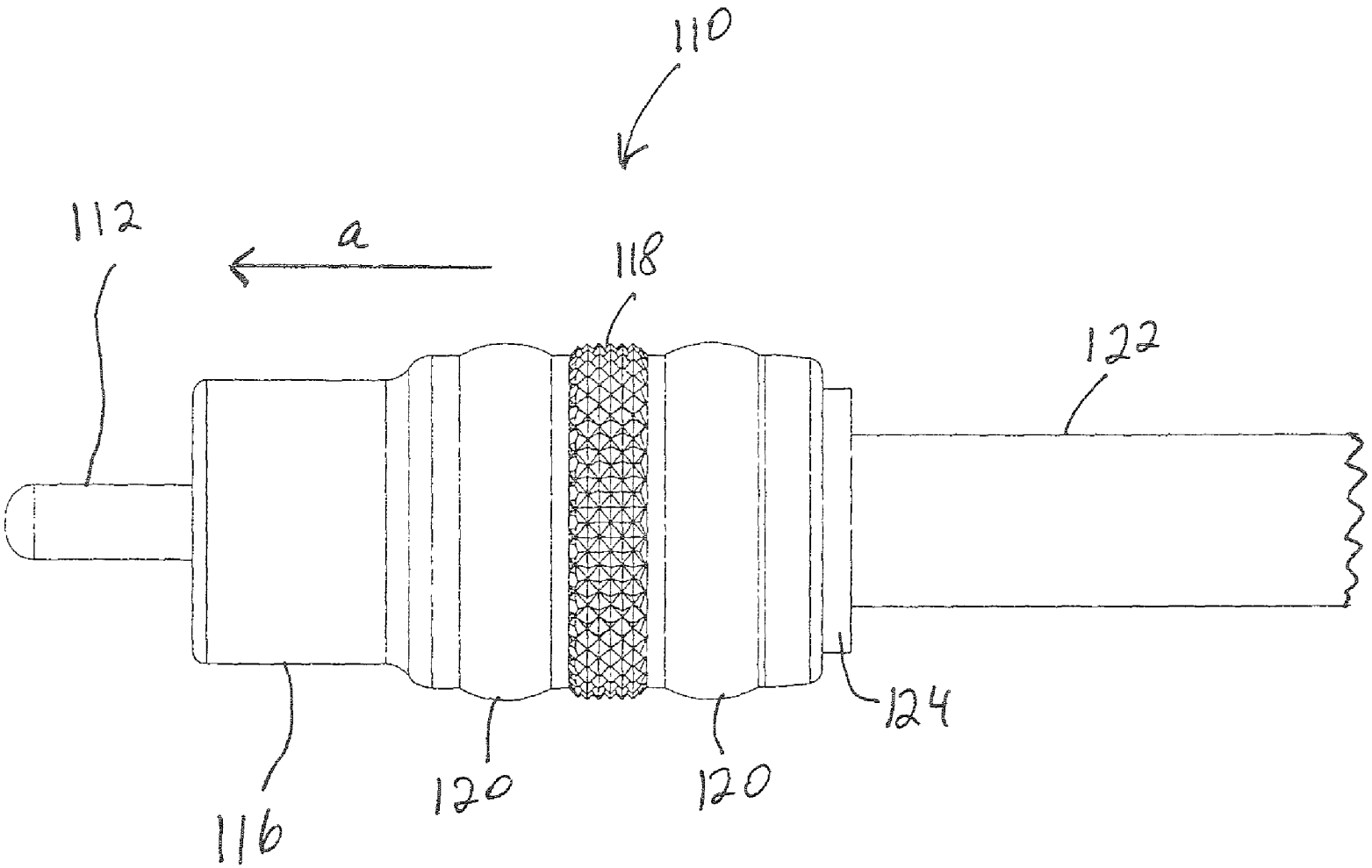
FIG. 7 shows a side elevation view of an RCA coaxial cable connector according to an embodiment of the present invention in a locked position.

Referring to FIG. 7, cable connector 110 is shown in the installed and locked state. Even though the equipment port is not shown, note that outer sleeve 116 has been advanced relative to the remainder of cable connector 110 in the direction as shown by an arrow a, so that engagement fingers 114 are no longer visible at one end of cable connector 110, but leaving an indicator 124 extending or showing at another end of cable connector 110.

Figure 8:
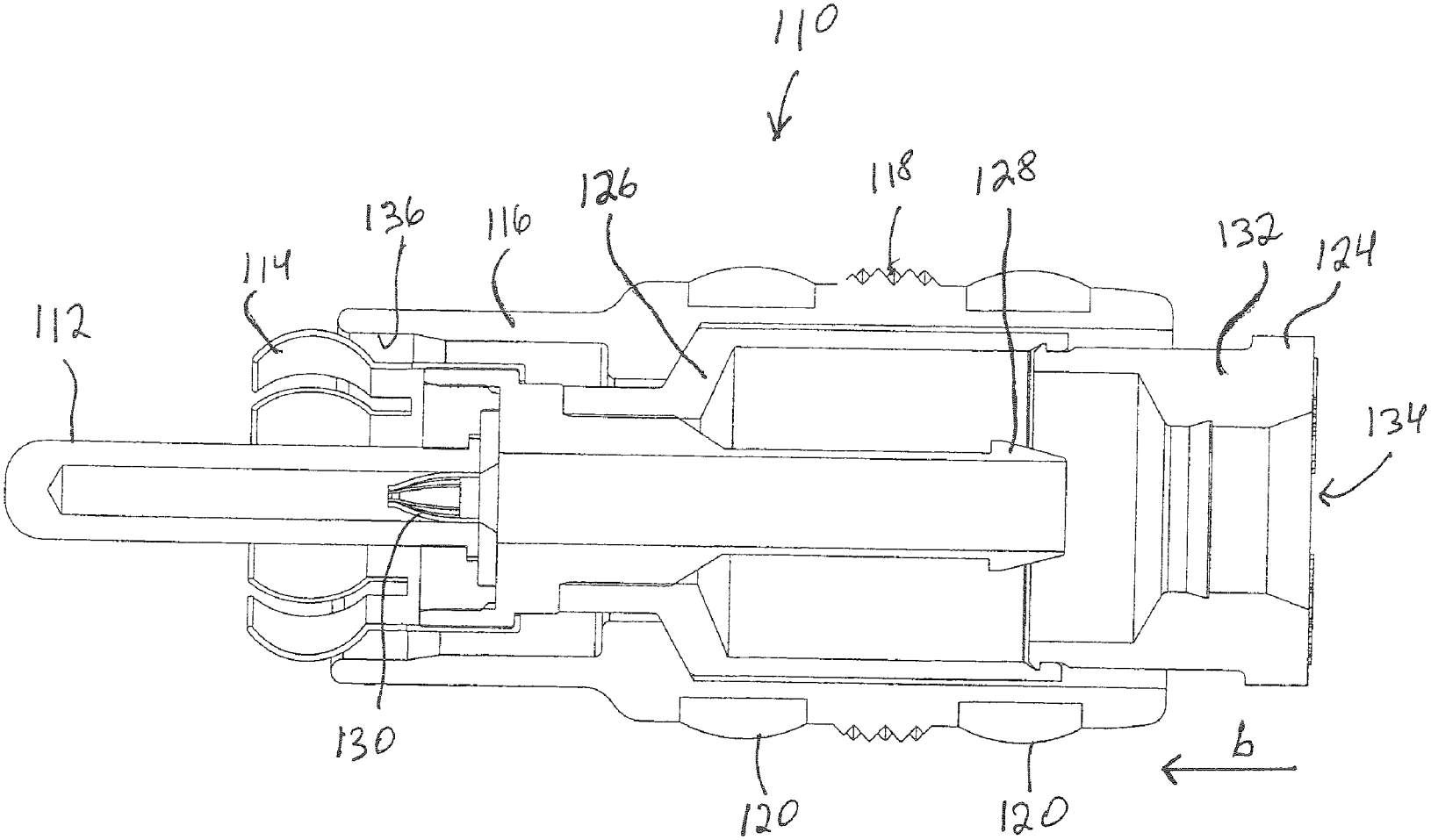
FIG. 8 shows a cross-sectional view of an RCA coaxial cable connector according to an embodiment of the present invention in an uninstalled position.

Referring to FIG. 8, cable connector 110 is in the uninstalled and unlocked state. That is, cable connector 110 is not connected to coaxial cable 122 (FIGS. 6-7), nor is it connected to and locked on the equipment port (not shown). To install coaxial cable 122, the end of coaxial cable 122 is prepared as is well known to one of ordinary skill in the art, leaving a center conductor (not shown) extending from a dielectric, ground sheath, and outer sheath (all not shown). When the prepared end of coaxial cable 122 is inserted into cable connector 110 through an opening 134, the center conductor is guided and seized by a collet 130, while a post 128 is inserted between the dielectric and the ground sheath. A compression sleeve 132 is then moved in the direction of an arrow b, where a friction fit between compression sleeve 132 and a connector body 126 holds coaxial cable 122 in place. After cable connector 110 is installed on coaxial cable 122, cable connector 110 appears as shown in FIG. 9.

Figure 9:
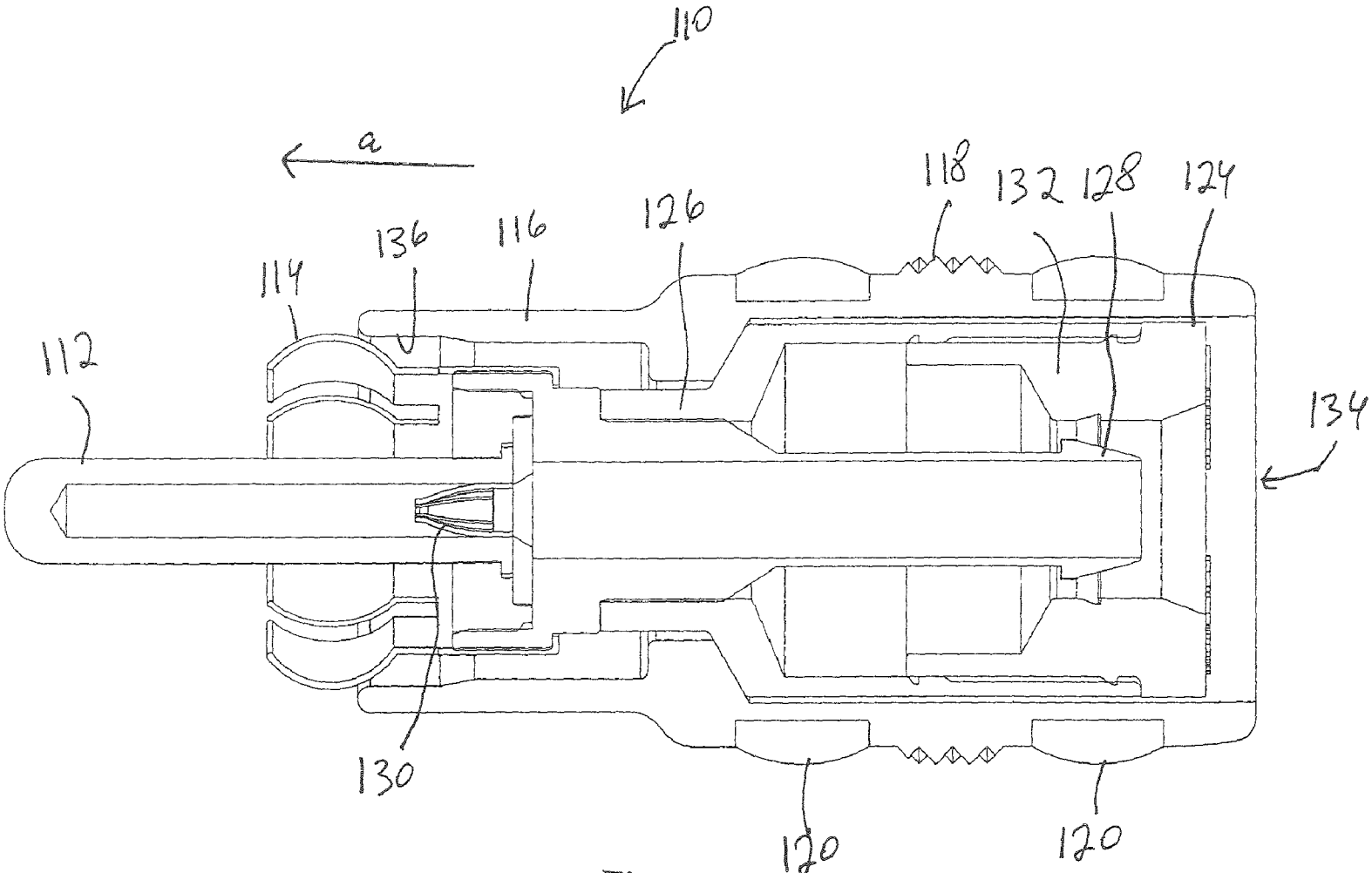
FIG. 9 shows a cross-sectional view of an RCA coaxial cable connector according to an embodiment of the present invention in the unlocked position.

Referring to FIG. 9, coaxial connector 110 is shown in the installed (onto coaxial cable 122) but unlocked position. When coaxial connector 110 is connected to the equipment port (not shown), outer sleeve 116 is grasped by an installer and engagement fingers 114 are slid over the equipment port in the direction shown by arrow a. When outer sleeve 116 is pushed further in the direction of arrow a, a locking surface 136 on an underside of outer sleeve 16 rides over engagement fingers 114, forcing and locking engagement fingers 114 onto the equipment port. Before this step, indicator 124 is not visible outside of outer sleeve 116.

Figure 10:
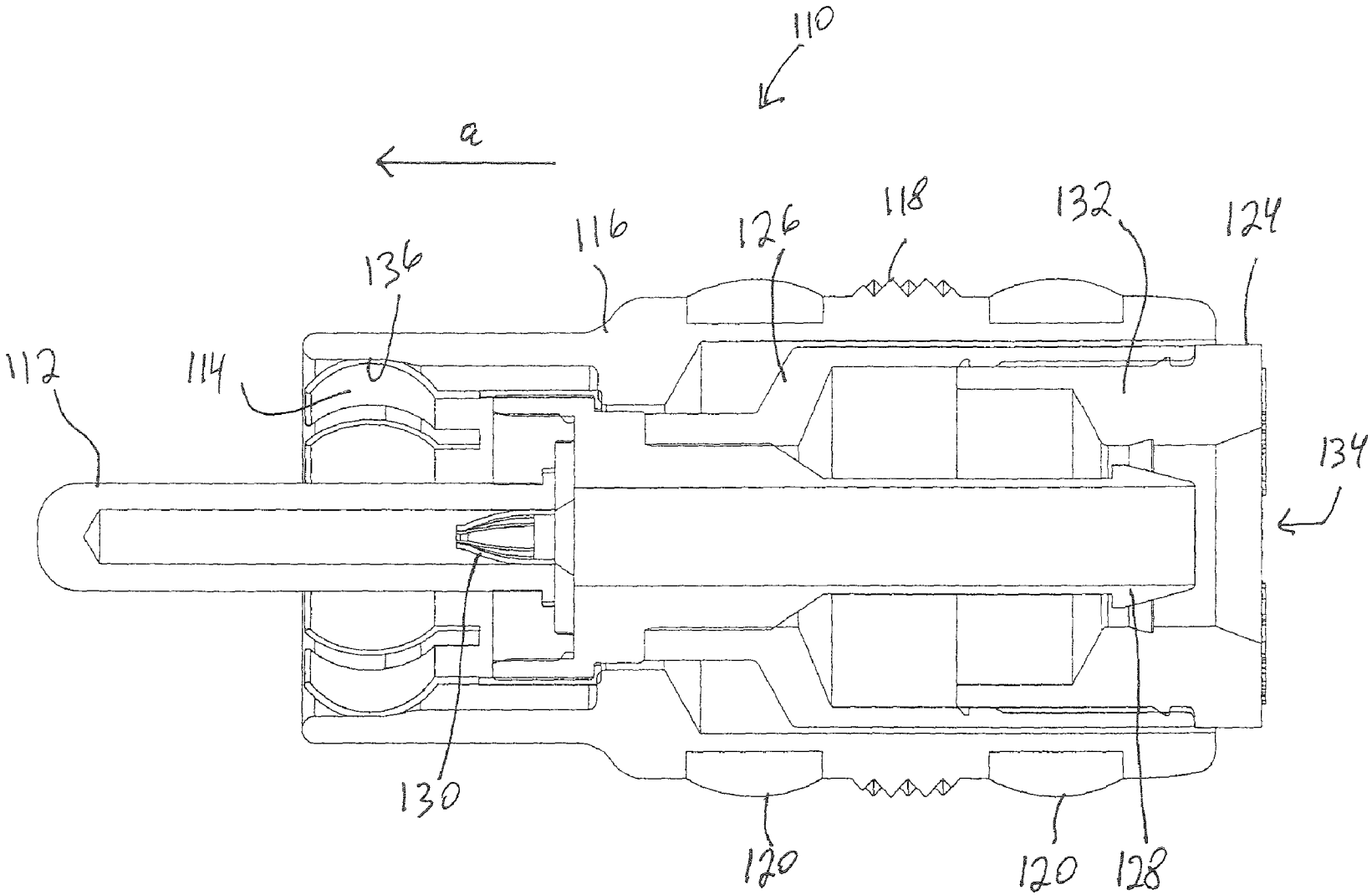
FIG. 10 shows a cross-sectional view of an RCA coaxial cable connector according to an embodiment of the present invention in the locked position.

Referring to FIG. 10, coaxial cable 110 is shown in the installed and locked position. Locking surface 136 is fully over engagement fingers 114, locking engagement fingers 114 onto the equipment port, while the movement of outer sleeve 116 leaves indicator 124 visible to the installer. The installer thus does not have to see that engagement fingers 114 are fully connected to the equipment port because the same information is communicated by the appearance of indicator 124. Indicator 124 optionally includes a colored annular stripe thereon, a textured annular stripe, an annular groove therein, or a colored elastomeric band that fits into the annular groove so as to make the indicator either more visible to the installer or capable of being felt easily by the installer.

Figure 11:
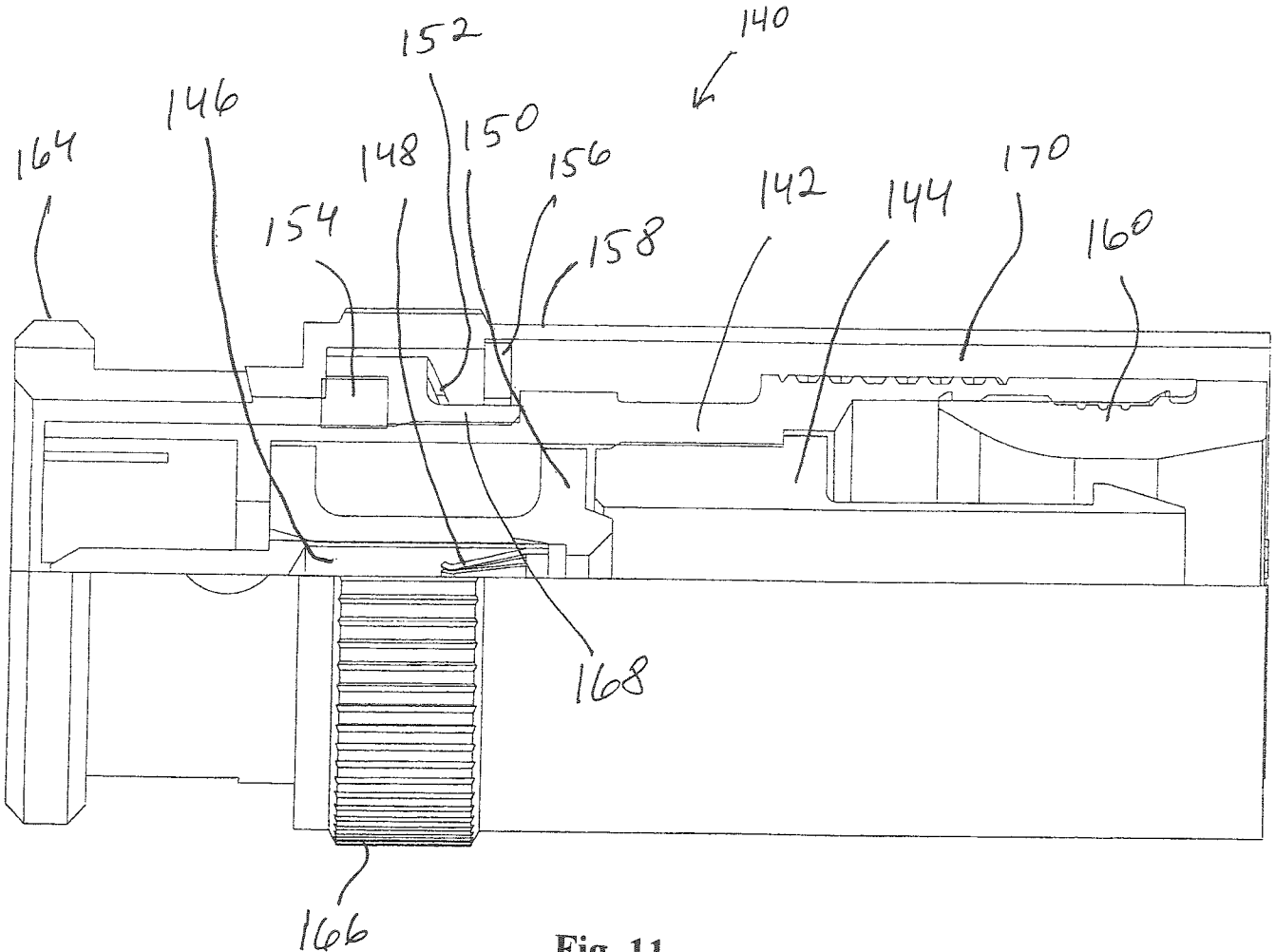
FIG. 11 shows a partial cutaway view of a BNC coaxial cable connector according to an embodiment of the invention in the unlocked position.

Referring to FIG. 11, a BNC cable connector 140 is shown. An inner body 142 is positioned within an outer body 158 with a retaining washer 156. A retaining ring 168 is preferably press-fitted onto inner body 142 to provide a surface for a wave washer 152 to press against. Wave washer 152 provides a biasing force to a bayonet sleeve 164, which bayonet sleeve 164 makes the twist-lock connection to an equipment port (not shown) that is characteristic of BNC connectors. The space between a portion of outer body 158 and inner body 142 forms an air cavity 170, which does not need to be sealed from the environment because BNC connectors are primarily used indoors or other enclosed spaces.

Inner body 142 contains a post/mandrel 144 which fits between the dielectric and the outer braid of the prepared coaxial cable (not shown) installed in cable connector 140. The center conductor of the coaxial cable is captured within a collet 148, which collet 148 is electrically conductive and mechanically connected to a contact pin 146 of cable connector 140. Contact pin 146 is positioned within inner body 142 by an insulator 150. A conductive gasket 154 provides RF sealing protection. A compression sleeve 160 fits inside an end of inner body 142 when the coaxial cable is fully installed in cable connector 140.

Figure 12:
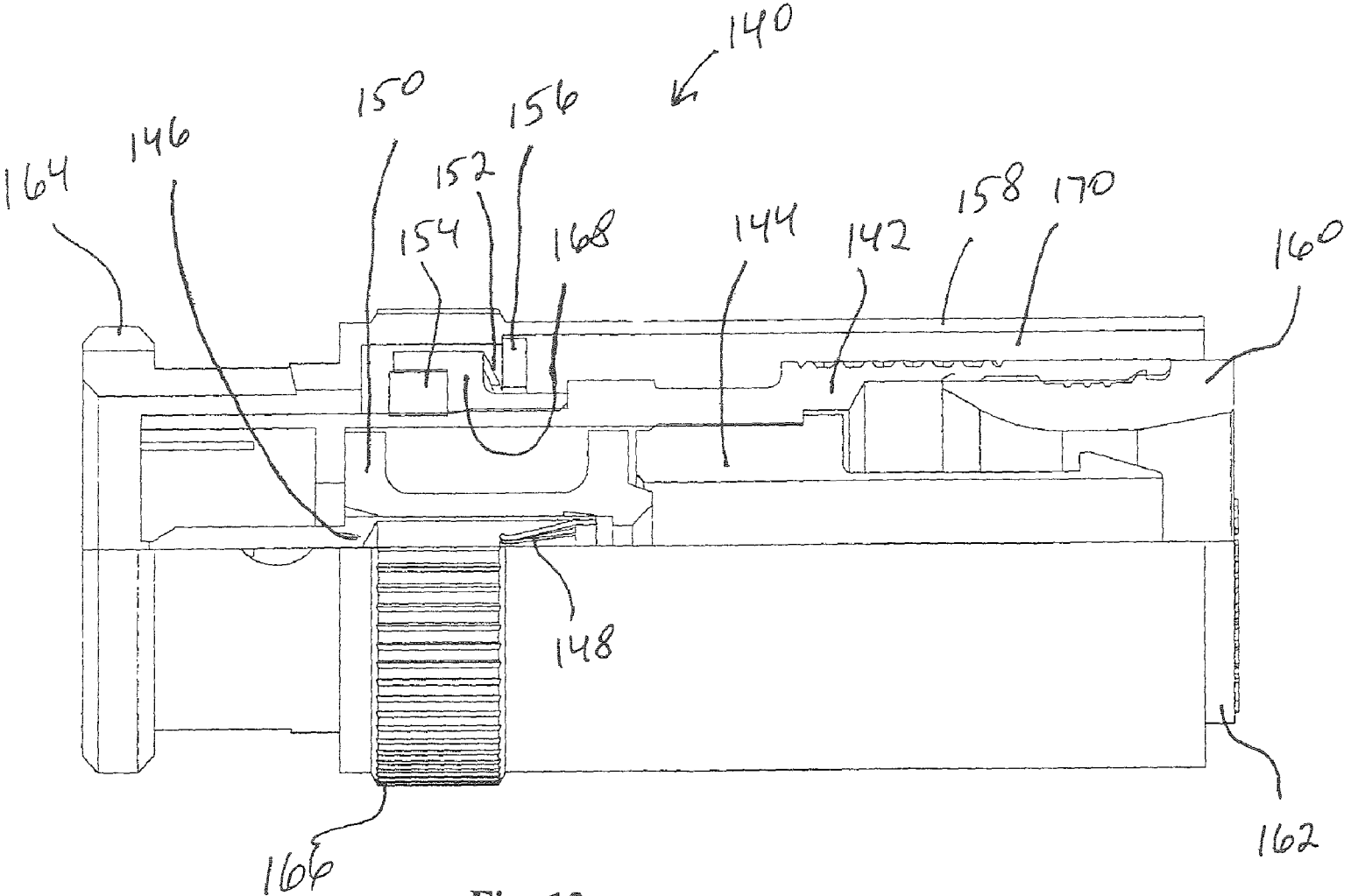
FIG. 12 shows a partial cutaway view of a BNC coaxial cable connector according to an embodiment of the invention in the locked position.

In this embodiment of the present invention, bayonet sleeve 164 is one-piece with outer body 158, so that when a knurled portion 166 of outer body 158 is grasped by a user and press-twisted to lock bayonet sleeve 164 onto the equipment port (not shown), the entire outer body 158 moves relative to inner body 142, resulting in the relative positions shown in FIG. 12. Thus, after cable connector 140 is installed onto the equipment port, an indicator portion 162 of compression sleeve becomes visible to the user. In the prior art, the "outer body" generally consists of the "knurled portion" only. The major features of this embodiment is that outer body 158 is one-piece with bayonet sleeve 164 and outer body 158 is extended over inner body 142 to hide inner body 142 and compression sleeve 160 from the user's vision before cable connector 140 is installed onto an equipment port.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable connector, comprising:

an outer body having a first end and an opposing second end;

an inner body having a first inner end and a second inner end;

a post interconnected with the inner body;

a fastener portion at the first end of the outer body; and a compression sleeve disposed to fit on the second inner end;

wherein the post, the inner body, and the compression sleeve are moveable with respect to the outer body between a first position in which the connector is not mounted to an equipment port and a second position when the connector is mounted to the equipment port;

wherein, when the fastener portion is not mounted to the equipment port, an indicator portion on the compression sleeve is not visible to a user, and when the fastener portion is mounted to the equipment port, the indicator portion on the compression sleeve is made visible to the user;

wherein the indicator portion is an elastomeric band in an annular groove in the compression sleeve.

2. A coaxial cable connector according to claim 1, wherein the indicator portion is an edge of the compression sleeve.

3. A coaxial cable connector according to claim 1, wherein the indicator portion includes a colored annular stripe thereon.

4. A coaxial cable connector according to claim 1, wherein the indicator portion includes a textured annular stripe thereon.

5. A coaxial cable connector according to claim 1, wherein:

the first end of the outer body includes a bayonet sleeve; and the fastener is a BNC connector.

6. A coaxial cable connector for connection to an equipment port, comprising:

a connector body having a first end and a second end;

the first end including a fastener portion which is directly connectable to the equipment port;

the second end including an indicator portion;

a plurality of engagement fingers disposed proximate the first end of the connector body;

an outer sleeve mounted on the connector body for movement between a first position wherein the outer sleeve covers the indicator portion and a second position wherein the outer sleeve visibly exposes the indicator portion on the connector body and covers the engagement fingers.

7. A coaxial cable connector according to claim 6, wherein the indicator portion is an edge of a compression sleeve.

8. A coaxial cable connector according to claim 6, wherein the indicator portion is a groove in a compression sleeve.

9. A coaxial cable connector according to claim 6, wherein the indicator portion includes a colored annular stripe thereon.

10. A coaxial cable connector according to claim 6, wherein the indicator portion includes a textured annular stripe thereon.

11. A coaxial cable connector according to claim 6, wherein the indicator portion includes an elastomeric band in an annular groove.

12. A method for making a coaxial cable connector for connection to an equipment port, comprising the steps of:

forming an outer body having a first end and a second end;

forming an inner body having a first inner end and a second inner end;

forming a post interconnected with the inner body;

forming a fastener portion at the first end of the outer body;

forming a compression sleeve disposed to fit on the second inner end; and wherein the post, the inner body, and the compression sleeve are moveable with respect to the outer body between a first position in which the connector is not mounted to an equipment port and a second position when the connector is mounted to the equipment port;

wherein, when the fastener portion is not mounted to the equipment port, an indicator portion on the compression sleeve is not visible to a user, and when the fastener portion is mounted to the equipment port, the indicator portion on the compression sleeve is made visible to the user;

wherein the indicator portion is an elastomeric band in an annular groove in the compression sleeve.

13. A method according to claim 12, wherein the indicator portion is formed as an edge of the compression sleeve.

14. A method according to claim 12, wherein the step of forming the indicator portion includes placing a colored annular stripe thereon.

15. A method according to claim 12, wherein the step of forming the indicator portion includes forming a textured annular stripe thereon.

16. A method of claim 12, further comprising the steps of:

forming an end of the outer body as a bayonet sleeve;

forming the fastener portion as a BNC compatible fastener.

17. A method of installing coaxial cable connector to an equipment port, wherein the connector includes an outer body having a first end and an opposing second; an inner body, a fastener portion at the first end of the outer body, a compression sleeve disposed to fit on the second inner end; wherein the post, the inner body, and the compression sleeve are moveable with respect to the outer body between a first position in which the connector is not mounted to an equipment port and a second position when the connector is mounted to the equipment port; wherein, when the fastener portion is not mounted to the equipment port, an indicator portion on the compression sleeve is not visible to a user, and when the fastener portion is mounted to the equipment port, the indicator portion on the compression sleeve is made visible to the user; wherein the indicator portion is an elastomeric band in an annular groove in the compression sleeve, the method comprising the steps of:

fitting the fastener portion over the equipment port;

moving the outer body to the second position; and checking to ensure that the indicator portion is not concealed by the outer sleeve.

* * * * *